US009861163B2

(12) United States Patent
Leo

(10) Patent No.: US 9,861,163 B2
(45) Date of Patent: Jan. 9, 2018

(54) SHOE CHARM HOLDER DEVICE

(71) Applicant: Susan Leo, Newfane, NY (US)

(72) Inventor: Susan Leo, Newfane, NY (US)

( * ) Notice: Subject to any disclaimer, the term of this patent is extended or adjusted under 35 U.S.C. 154(b) by 1247 days.

(21) Appl. No.: 13/734,003

(22) Filed: Jan. 4, 2013

(65) Prior Publication Data

US 2013/0180136 A1 Jul. 18, 2013

Related U.S. Application Data

(63) Continuation-in-part of application No. 13/421,927, filed on Mar. 16, 2012, which is a continuation-in-part of application No. 12/859,916, filed on Aug. 20, 2010, now Pat. No. 8,544,196.

(51) Int. Cl.
*A43B 23/00* (2006.01)
*A43B 11/00* (2006.01)
*A43B 23/24* (2006.01)

(52) U.S. Cl.
CPC ..... *A43B 23/24* (2013.01)

(58) Field of Classification Search
CPC .... A43B 3/30; A43B 5/00; A43B 5/02; A43B 5/01; A43B 23/24; A43B 13/34; A43C 15/161
USPC ..... 36/112, 34 R, 114, 134
See application file for complete search history.

(56) References Cited

U.S. PATENT DOCUMENTS 979,361 A 12/1910 Vttlpescu et al.
1,414,748 A 5/1922 Palmer
1,484,785 A 2/1924 Hiss
1,825,029 A * 9/1931 Fritz ..... 24/105
1,919,095 A 7/1933 De Gennaro
2,096,335 A 10/1937 Nicholas
2,139,885 A 12/1938 De Gironimo
2,174,521 A 10/1939 Lancaster
2,552,151 A 5/1951 Cohen
2,689,417 A 9/1954 Bernstein et al.
2,723,344 A 11/1955 Greminger
2,748,517 A 6/1956 Berkis
3,141,211 A 7/1964 Blake
3,354,561 A 11/1967 Cameron
(Continued)

OTHER PUBLICATIONS

United States Patent and Trademark Office, Final Office Action dated, May 7, 2014 for U.S. Appl. No. 13/421,927.
(Continued)

*Primary Examiner* — Sharon M Prange
*Assistant Examiner* — Timothy K Trieu
(74) *Attorney, Agent, or Firm* — Hansen IP Law PLLC

(57) ABSTRACT

A charm holder device for attaching charms to a shoe is shown and described. The charm holder device allows a charm to be selectively attached to and detached from the shoe. In certain examples, the charm holder device includes a substantially planar surface that is attached to the shoe and a decorative body projecting away from the substantially planar surface. A charm keeper is attached to the decorative body for attaching charms. In some of the described examples, the charm holder device is placed between the heel of the shoe and a ground-contacting portion of the shoe's sole such that the charm holder and the charm are spaced apart from the ground-contacting portion of the sole in a direction perpendicular to the ground-contacting portion of the sole.

26 Claims, 10 Drawing Sheets

(56) References Cited

U.S. PATENT DOCUMENTS

| | | | | |
|---|---|---|---|---|
| 3,357,063 | A | 12/1967 | Eiben | |
| 3,722,565 | A | 3/1973 | Miller et al. | |
| 3,893,247 | A | 7/1975 | Dana, III | |
| 3,946,505 | A | 3/1976 | Dana, III | |
| 4,033,243 | A | 7/1977 | Kirrish et al. | |
| 4,050,167 | A | 9/1977 | Senter | |
| 4,128,861 | A | 12/1978 | Pelengaris | |
| 4,164,971 | A | 8/1979 | Strand | |
| 4,202,117 | A | 5/1980 | Bidegain | |
| 4,476,639 | A * | 10/1984 | Zaccaria | A43B 5/00 36/114 |
| 4,490,083 | A | 12/1984 | Rebish | |
| 4,805,320 | A | 2/1989 | Goldenberg et al. | |
| 4,887,369 | A | 12/1989 | Bailey et al. | |
| 5,079,857 | A | 1/1992 | Clifton | |
| 5,243,776 | A | 9/1993 | Zelinko | |
| 5,244,326 | A | 9/1993 | Henriksen | |
| 5,290,131 | A | 3/1994 | Henriksen | |
| 5,371,662 | A | 12/1994 | Shenk-Ko | |
| 5,461,814 | A * | 10/1995 | Reid et al. | 43/1 |
| 5,490,338 | A | 2/1996 | Hwang et al. | |
| 5,549,234 | A | 8/1996 | Hong | |
| 5,655,317 | A | 8/1997 | Grant | |
| 5,673,501 | A | 10/1997 | Mathews | |
| 5,926,980 | A | 7/1999 | Adam | |
| 6,012,763 | A | 1/2000 | Clemente et al. | |
| 6,266,853 | B1 | 7/2001 | Ho | |
| 6,345,472 | B1 | 2/2002 | Taylor | |
| 6,354,231 | B1 | 3/2002 | Morris | |
| 6,434,870 | B1 | 8/2002 | Fanjoy | |
| 6,442,872 | B1 | 9/2002 | Liao | |
| 6,481,122 | B2 | 11/2002 | Brahler | |
| 6,502,332 | B1 | 1/2003 | Nakayama | |
| 6,698,986 | B2 | 3/2004 | Fraleigh | |
| 7,004,699 | B2 | 2/2006 | Petrok et al. | |
| 7,059,070 | B2 | 6/2006 | Omstead et al. | |
| 7,076,894 | B2 | 7/2006 | Santos et al. | |
| 7,578,075 | B1 | 8/2009 | Kemp | |
| 7,661,208 | B2 | 2/2010 | McKinney et al. | |
| 7,695,154 | B2 | 4/2010 | Ellenburg et al. | |
| 7,713,013 | B2 | 5/2010 | Sedgwick et al. | |
| 7,877,902 | B2 | 2/2011 | Pieriboni | |
| 7,937,966 | B2 | 5/2011 | Golove et al. | |
| 7,987,619 | B2 | 8/2011 | McKinney et al. | |
| 7,988,397 | B2 | 8/2011 | Bodin et al. | |
| 8,001,664 | B2 | 8/2011 | Pearce | |
| 8,069,583 | B1 | 12/2011 | Simchuk | |
| 8,210,785 | B1 | 7/2012 | Gager | |
| 2006/0026990 | A1 | 2/2006 | Carter | |
| 2006/0075662 | A1 | 4/2006 | Schupbach | |
| 2006/0180728 | A1 | 8/2006 | Abrantes | |
| 2008/0289076 | A1 | 11/2008 | Millward | |
| 2009/0100869 | A1 | 4/2009 | Golove et al. | |
| 2009/0249654 | A1 | 10/2009 | Baucom et al. | |
| 2010/0239386 | A1 | 9/2010 | Sedgwick et al. | |
| 2010/0289971 | A1 | 11/2010 | Odland et al. | |
| 2010/0307031 | A1 | 12/2010 | Ganito | |
| 2011/0083341 | A1 | 4/2011 | Baum | |
| 2012/0137543 | A1 | 6/2012 | Kemp | |
| 2012/0186105 | A1 | 7/2012 | Kemp et al. | |
| 2014/0130379 | A1 * | 5/2014 | Floriot Godin | A43B 1/0081 36/101 |

OTHER PUBLICATIONS

United States Patent and Trademark Office, Non-Final Office Action dated Nov. 25, 2013 for U.S. Appl. No. 13/421,927.

* cited by examiner

SHOE CHARM HOLDER DEVICE

CROSS-REFERENCE TO RELATED APPLICATIONS

This is a continuation-in-part of U.S. patent application Ser. No. 13/421,927, filed Mar. 16, 2012 which is a continuation-in-part of U.S. patent application Ser. No. 12/859,916, filed Aug. 20, 2010, each of which are hereby incorporated herein by reference.

FIELD

This disclosure relates to charm holder devices for attachment to shoes.

BACKGROUND

Certain known shoe designs include a variety of fixed and selectively detachable decorative features. However, known designs do not include the ability to attach dangling charms to the sole of a shoe or other shoe surfaces with a downward facing component. Thus, a need has arisen for a charm holder device.

DETAILED DESCRIPTION

Figure 1:
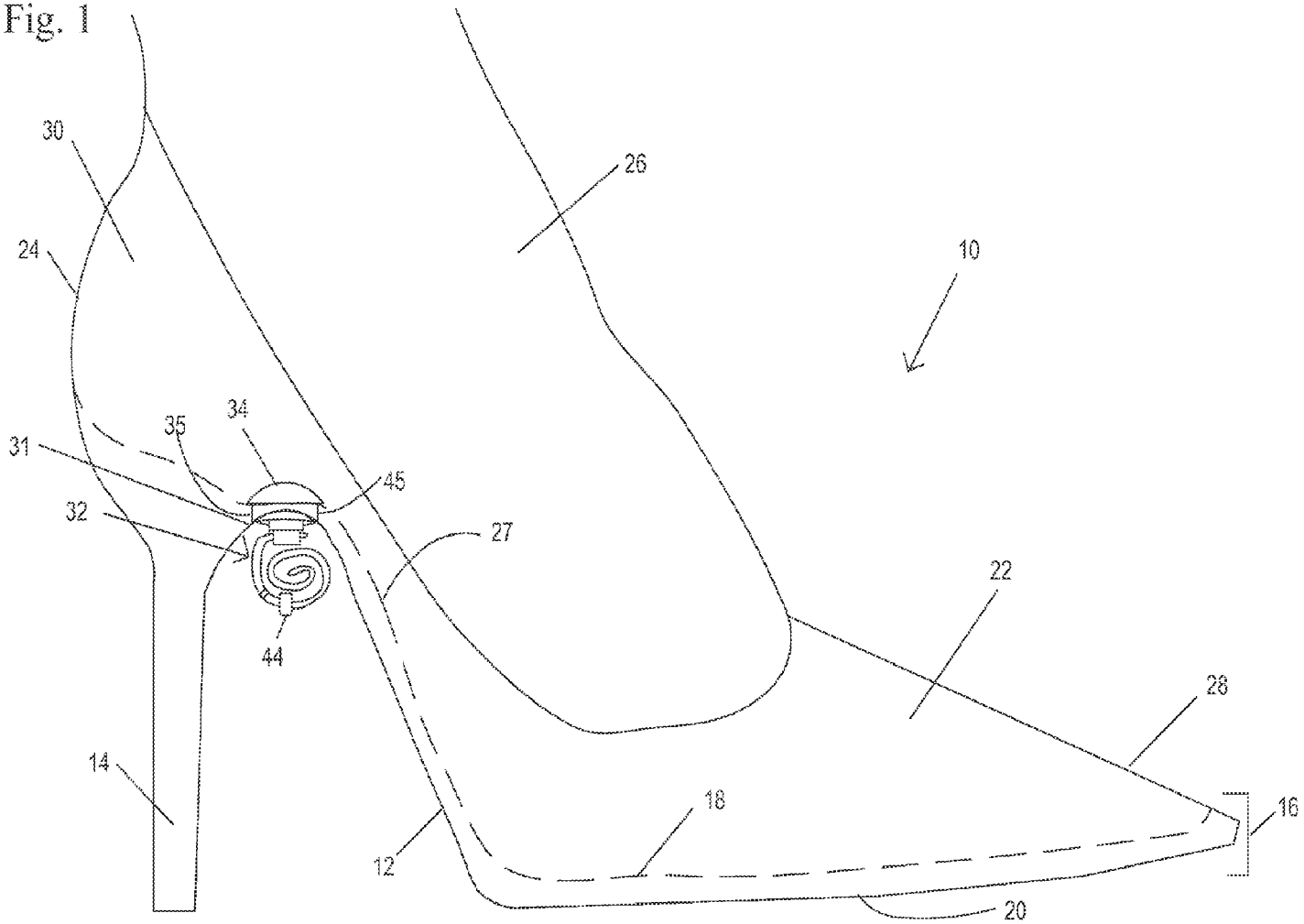
FIG. 1 shows a schematic of a shoe with a shoe charm holder device in a first a embodiment.
Figure 9:
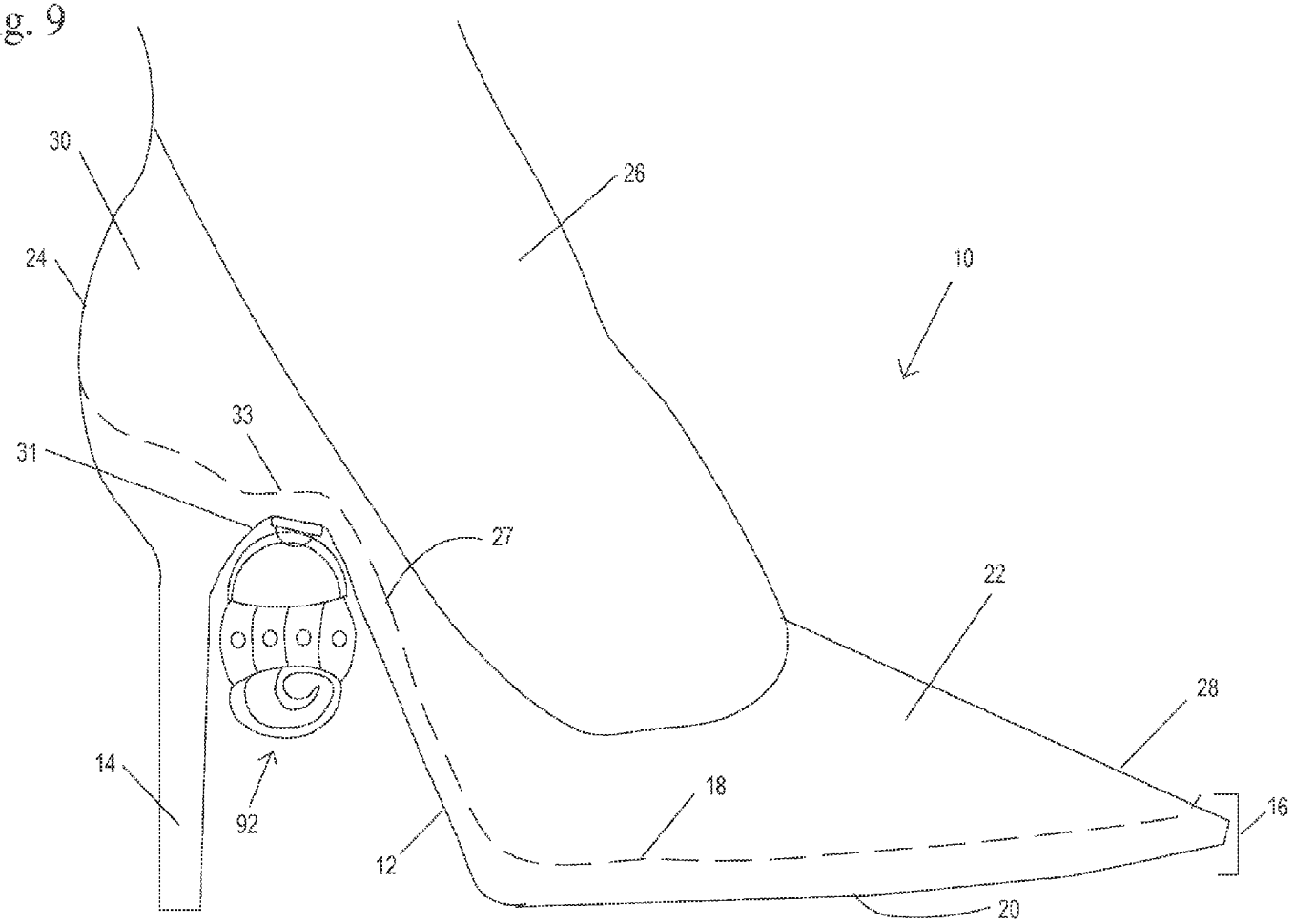
FIG. 9 shows a schematic of a shoe with a shoe charm holder device attached to an outer sole of the shoe of a third embodiment.

As shown in FIGS. 1 and 9, a shoe 10 includes a shank 12 connected to a heel 14, through a heel breast 31 and a sole assembly 16. The shoe 10 also includes an upper covering of the toe region 22 and a counter 24 to support a heel of a wearer's foot 26. The sole assembly 16 includes an insole or inner sole 18 in the interior bottom of the shoe directly beneath the wearer's foot and an outer sole or outsole 20 in contact with the ground. The insole 18 is configured with the foot shape profile of the shoe with a toe end 28, connected to an arch profile 27 corresponding to the natural curvature of the foot's arch through to a heel end 30. The outsole 20 may be made of any suitable outsole material including, but not limited to leather, PVC, polyurethane, TPR, rubber or any combination thereof.

In the first embodiment shown in FIGS. 1 through 5, a bore 35 is present on the heel breast 31 between the shank 12 and the heel 14 of the shoe. The bore 35 extends from the insole 18 through to the outsole 20. The bore 35 receives a portion of a charm holder device 32.

Figure 2:
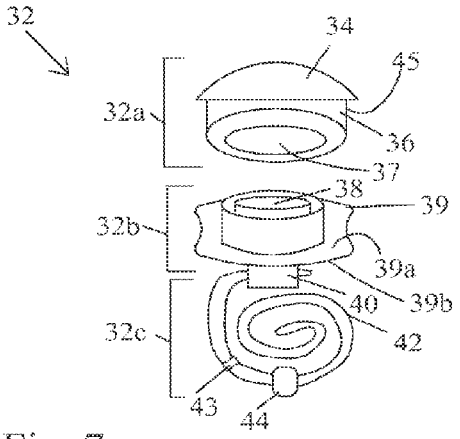
FIG. 2 shows a schematic of a shoe charm holder device of a first embodiment.
Figure 3:
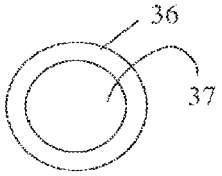
FIG. 3 shows a schematic of a bottom view of the shoe engaging portion of the shoe charm holder device of a first embodiment received by an insole of a shoe.

Referring to FIG. 2, the shoe charm holder device 32 has an attachment portion 32*a* which attaches the shoe charm holder device 32 to the shoe 10; a shoe engaging portion 32*b* which is coupled to the attachment portion 32*a* and couples the charm engaging portion 32*c* to the shoe 10; and a charm engaging portion 32*c* for receiving charms or beads 44.

In the first embodiment, the attachment portion 32*a* of the shoe charm holder device 32 includes a cap head 34 connected to a female socket 36 with outer walls 45 received by a bore 35 on the heel breast 31 of the shoe. The female socket 36 defines an opening 37 for receiving a protruding male snap stud 38 as shown in FIG. 2.

The cap head 34 is preferably mounted perpendicular to outer sides 45 of the female socket 36. The outer sides 45 of the female socket 36 are received within the bore 35. The cap head 34 preferably has a diameter that is larger than the diameter of the bore 35, preventing the cap head 34 from moving from the insole 18 to the outsole 20 through the bore 35. The cap head 34 is preferably shaped such that the cap head 34 is unobtrusive to the wearer's foot. The cap head 34 may be a pan head, a button or dome head, a round head, or a truss head, or any other type of head that is unobtrusive to the wearer's foot.

Figure 4:
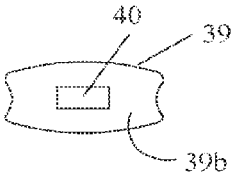
FIG. 4 shows a schematic of a bottom view of the charm engaging portion of the shoe charm holder device of a first embodiment received by the shoe engaging portion of the shoe charm holder.

The shoe engaging portion 32*b* includes a base 39 with a first side 39*a* including a protruding male snap stud 38 and a second side 39*b* with a nipple 40 for coupling to a charm keeper 42 of the charm engaging portion 32*c* as shown in FIG. 4. The shoe engaging portion 32*b* attaches to the attachment portion by snapping the protruding male snap stud 38 into the female socket 36.

The charm keeper 42 may be fixedly attached to the nipple 40 or removably attached to the nipple 40 through a clasp (not shown). The charm keeper 42 has a hinge 43 which allows the charm keeper 42 to be moved from a first position in which charms or beads 44 may be added or removed from the charm keeper 42 to a second position in which charms or beads 44 are prevented from being removed or dislodged from the charm keeper 42.

Figure 5:
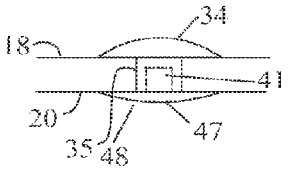
FIG. 5 shows a cap received by the attachment portion of the shoe charm holder device of a first embodiment when a wearer does not want to attach the charm engaging portion of the shoe charm holder device.

Referring to FIG. 5 when a wearer does not wish to have the charm engaging portion 32*c* present on the heel breast 31 of the shoe, a separate male cap stud 48 with a head 47 is received by the female socket 36 of the attachment portion 32*a*, such that when the protruding male snap stud 41 of the separate male cap stud 48 snaps into the female socket 36, with the head 47 resting against the outer sole 20 of the shoe 10, the shoe charm holder device 32 appears flat or nearly flush with the outer sole 20 of the underside of the shoe 10.

Figure 7:
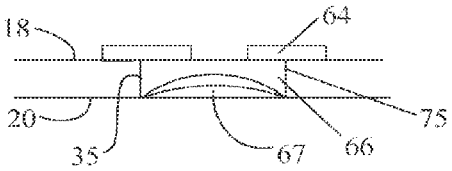
FIG. 7 shows a schematic of a cap of the shoe charm holder device received by an insole of a shoe of a second embodiment.
Figure 6:
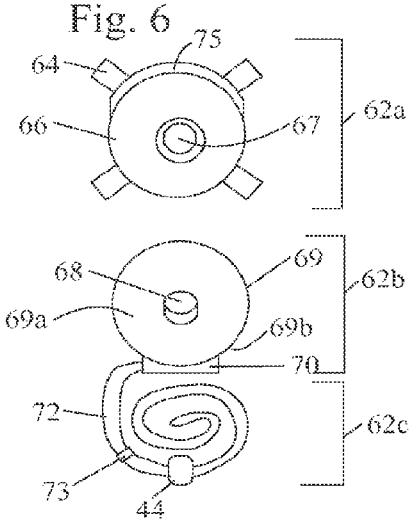
FIG. 6 shows a schematic of the attachment portion, shoe engaging portion, and the charm engaging portion of the shoe charm holder device of a second embodiment.
Figure 8:
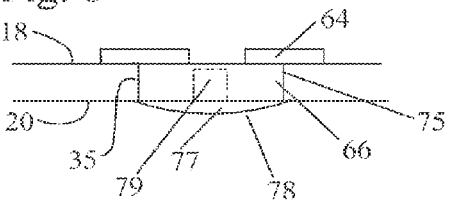
FIG. 8 shows a cap received by the attachment portion of the shoe charm holder device of a second embodiment when a wearer does not want to attach the charm engaging portion of the shoe charm holder device.

FIGS. 6-8 show an alternate charm holder device of a second embodiment received within a bore 35 on the heel breast 31 of the shoe 10 between the shank 12 and heel 14 of the shoe 10 that extends from the insole 18 through to the outsole 20.

In this embodiment, the shoe charm holder device 62 has an attachment portion 62*a* which attaches the shoe charm holder device 62 to the shoe 10; a shoe engaging portion 62*b* which is coupled to the attachment portion 62*a* and couples the charm engaging portion 62*c* to the shoe 10; and a charm engaging portion 62*c* for receiving charms or beads 44.

The attachment portion 62*a* of the shoe charm holder device 62 includes laterally extending tabs 64 that extend outwards from outer walls 75 of a female magnetic socket 66 received by the bore 35 and rest on or engage the insole 18 of the shoe 10. The tabs 64 prevent the female magnetic socket 66 from moving from the insole 18 to the outsole 20 through the bore 35. The tabs 64 lay flat on the insole 18 and are not obtrusive to the wearer's foot. The female socket 66 defines an opening 67 for receiving a protruding male snap stud 68 as shown in FIG. 6.

The shoe engaging portion 62*b* includes a base 69 with a first side 69*a* including a protruding male magnetic snap stud 68 and a second side 69*b* with a nipple 70 for coupling to a charm keeper 62 of the charm engaging portion 62*c*. The shoe engaging portion 62*b* attaches to the attachment portion 62*a* by magnetically snapping the protruding male snap stud 68 into the female socket 66.

The charm keeper 62 may be fixedly attached to the nipple 70 or removably attached to the nipple 70 through a clasp (not shown). The charm keeper 72 has a hinge 73 which allows the charm keeper 72 to be moved from a first position in which charms or beads 74 may be added or removed from the charm keeper 72 to a second position in which charms or beads 44 are prevented from being removed or dislodged from the charm keeper 72.

Referring to FIG. 8, when a wearer does not wish to have the charm engaging portion 62*c* present on the heel breast 31 of the shoe, a separate male cap stud 78 with a head 77 and a protruding male snap stud 79 is received by the female socket 66 of the attachment portion 62*a*, such that when the separate male cap stud 78 snaps into the female socket 66, with the head 77 resting against the outer sole 20 of the shoe 10, the shoe charm holder device 62 appears flat or nearly flush with the outer sole 20 of the underside of the shoe 10.

Figure 10:
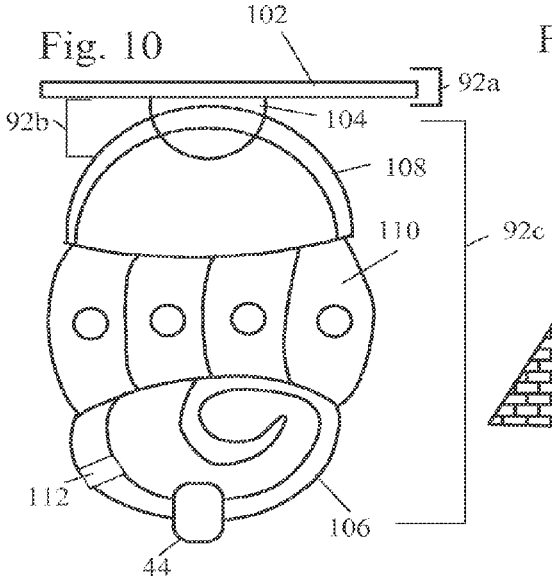
FIG. 10 shows an example of a shoe charm holder device design for attachment to the heel breast of a shoe.

FIGS. 9-10 shows a charm holder device 92 of a third embodiment. The shoe charm holder device 92 has an attachment portion 92*a* which attaches the shoe charm holder device 92 to the shoe 10; a shoe engaging portion 92*b* which is coupled to the attachment portion 92*a* and couples the charm engaging portion 92*c* to the shoe 10; and a charm engaging portion 92*c* for receiving charms or beads 44.

The attachment portion 92*a* is an attachment surface 102 that is directly attached to the outer sole 20 of the shoe. The attachment surface 102 may be fixedly attached to the outer sole 20 of the shoe 10 using an adhesive. Alternatively, the attachment surface 102 may be removably attached using a hook and loop fastener material, such as 3M® Dual Loop® Fastener or through magnets, where another magnet is placed underneath the insole 18 of the shoe 10 and the attachment surface 102 on the outer sole 20 of the shoe is magnetically attracted to the magnet underneath the insole 18 of the shoe. It should be noted that the adhesive, hook and loop fastener or the magnets need to be of sufficient strength to manage the weight of the shoe engaging portion 92*b* and the charm engaging portion 92*c* including any charms 44 and maintain the attachment of the shoe engaging portion 92*b* and the charm engaging portion 92*c* to the shoe 10.

Figure 14A:
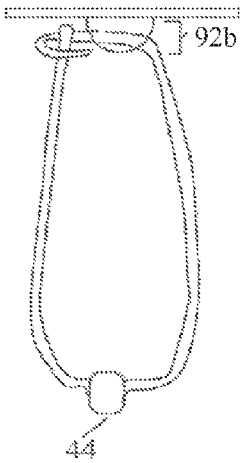
FIG. 14A shows another example of a shoe charm holder device design for attachment to the heel breast of a shoe in a first configuration.
Figure 14B:
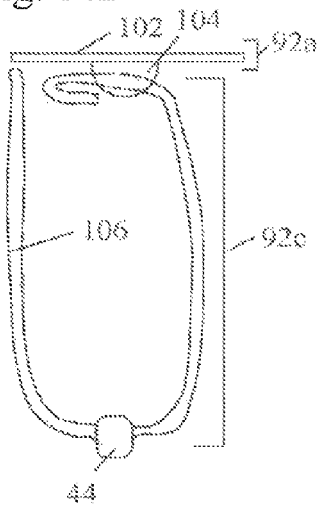
FIG. 14B shows the shoe charm holder device of FIG. 14A in a second configuration.

The shoe engaging portion 92*b* includes a nipple 104 for receiving a looped portion 108 for coupling to a charm keeper 106 of the charm engaging portion 92*c* for example as shown in FIGS. 14A-14B.

Figure 11:
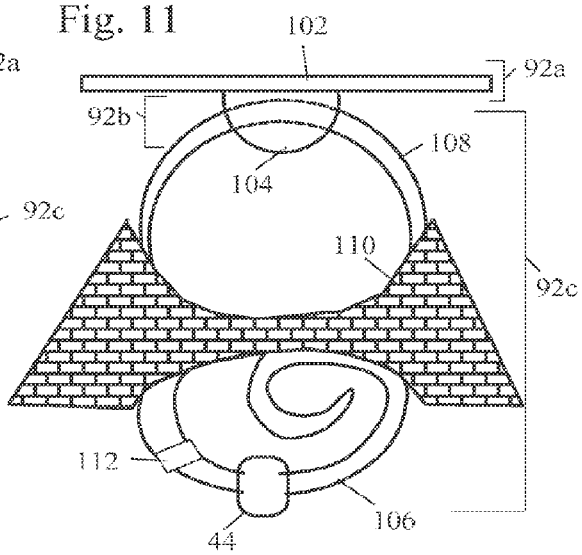
FIG. 11 shows another example of a shoe charm holder device design for attachment to the heel breast of a shoe.

The looped portion 108 may be coupled to the charm keeper 106 through a body 110 as shown in FIGS. 10 and 11. The body 110 may be of various shapes such as irregular polygons and skulls. The looped portion 108 may include a clasp that allows the looped portion to be removed from the nipple 104. The shoe engaging portion 92*b* is preferably fixedly attached to the attachment portion 92*a* through an adhesive or may be removably attached by magnets.

Figure 13:
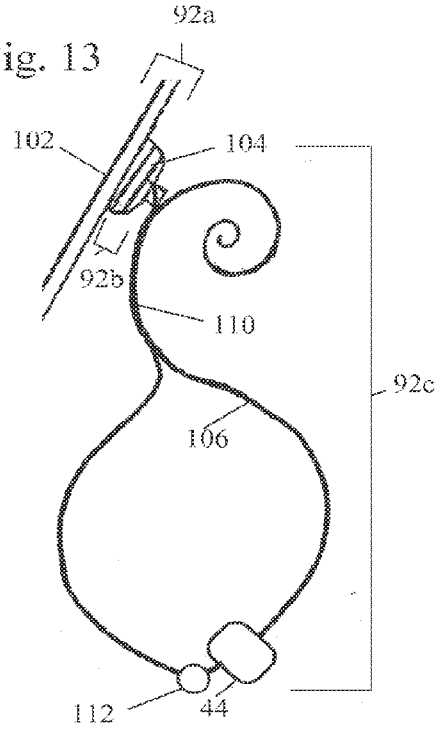
FIG. 13 shows another example of a shoe charm holder device design for attachment to the heel breast of a shoe.
Figure 15:
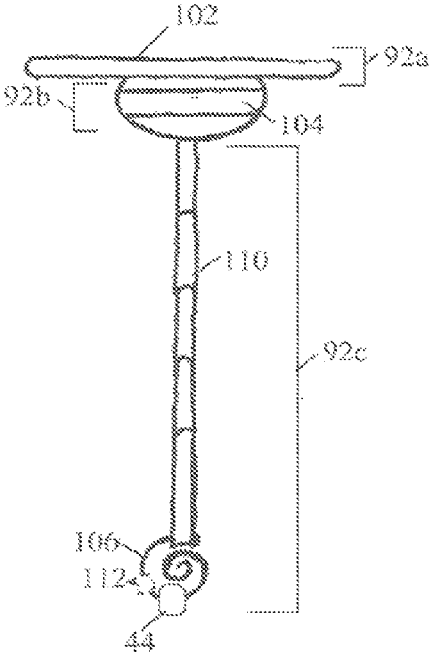
FIG. 15 shows another example of a shoe charm holder device design for attachment to the heel breast of a shoe.
Figure 16:
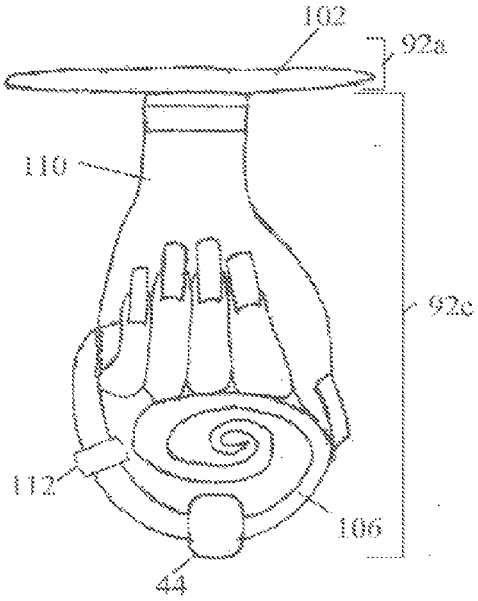
FIG. 16 shows another example of a shoe charm holder device design for attachment to the heel breast of a shoe.

Alternatively, shoe engaging portion 92*b* includes a nipple 104 which is directly attached to the body 110 of the charm engaging portion, for example as shown in FIGS. 13 and 15.

Figure 12:
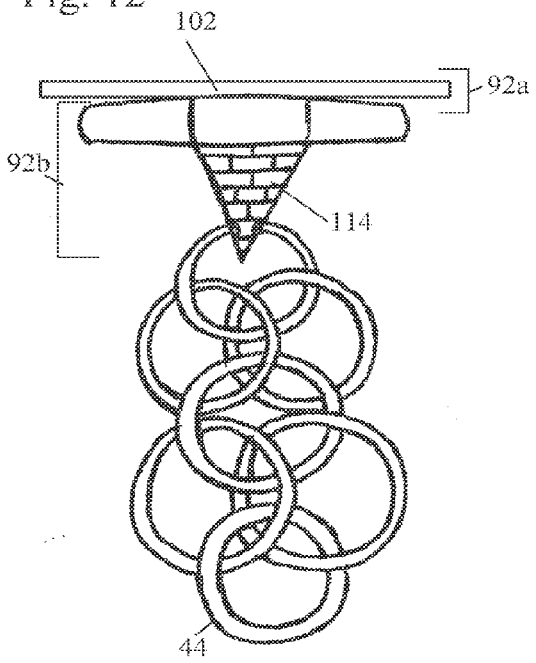
FIG. 12 shows another example of a shoe charm holder device design for attachment to the heel breast of a shoe.

In another embodiment, the shoe engaging portion 92*b* can include a triangular protrusion 114 which can be directly coupled to a charm 44, for example interconnected rings as shown in FIG. 12.

Figure 17:
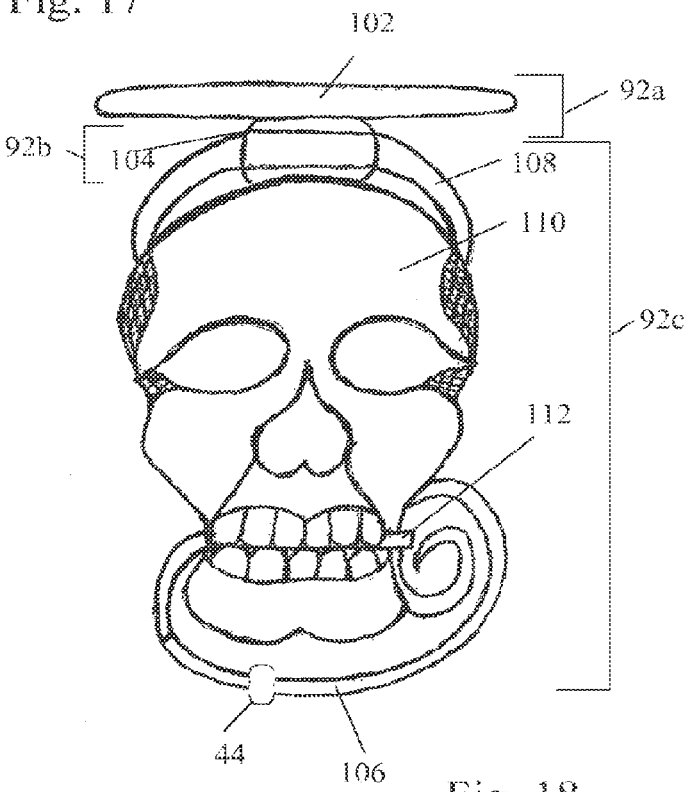
FIG. 17 shows another example of a shoe charm holder device design for attachment to the heel breast of a shoe.

In the charm holder devices of FIGS. 10-12, all or part of the body 110 is positioned between charm keeper 106 and shoe attachment portion 92*a* along a direction away from shoe attachment portion 92*a*. In FIGS. 10-12, the direction away from shoe attachment portion is perpendicular to the attachment surface 102 of shoe attachment portion 92*a*. The charm holder devices of FIGS. 17 and 18 are oriented similarly.

In another embodiment, the body 110 of the charm engaging portion 92*c* can be directly connected to the attachment portion 92*a*, eliminating the shoe engaging portion 92*b*. The body may be hand shaped, oval shaped, or tear drop shaped for example as shown in FIGS. 16, 18, and 14A-B respectively.

The charm keeper 106 may include a hinge 112 which allows the charm keeper 106 to be moved from a first position in which charms or beads 44 may be added or removed from the charm keeper 106 to a second position in which charms or beads 44 are prevented from being removed or dislodged from the charm keeper 106.

Figure 18:
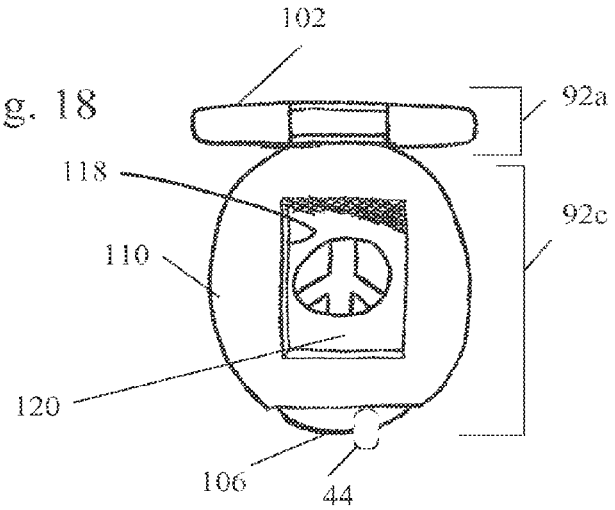
FIG. 18 shows another example of a shoe charm holder device design for attachment to the heel breast of a shoe.

Additionally, the body of the shoe charm holder device in any of the embodiments may have a cutout 118 for receiving decorative plates 120 as shown in FIG. 18.

The charms may be made of plastic, gold, silver, bronze, glass, nickel, or any other alloy.

It should be noted that the charms maybe of different lengths depending on the heel height of the shoe.

Furthermore, the charm or ornament 44 may be of any design that can be removeably attached to the charm keeper and is not limited to any of the designs shown in the drawings.

While the shoes in FIGS. 1 and 9 are shown with an upper covering 22 of the toe region of a wearer's foot and a counter 24 to support the heel of a wearer, the shoe may alternatively just have straps on the toe region and/or around the heel.

In certain examples, the shoe 10 in which the shoe charm holder device is installed preferably has a heel that is at least 0.5 inches above the ground or greater and preferably includes, but is not limited to, kitten heels, high heels, and stilettos. However, as will be discussed further below, the charm holder device may also be installed on wedge shoes that have no heel shank or other appreciable clearance between the outsole and the ground.

Figure 19:
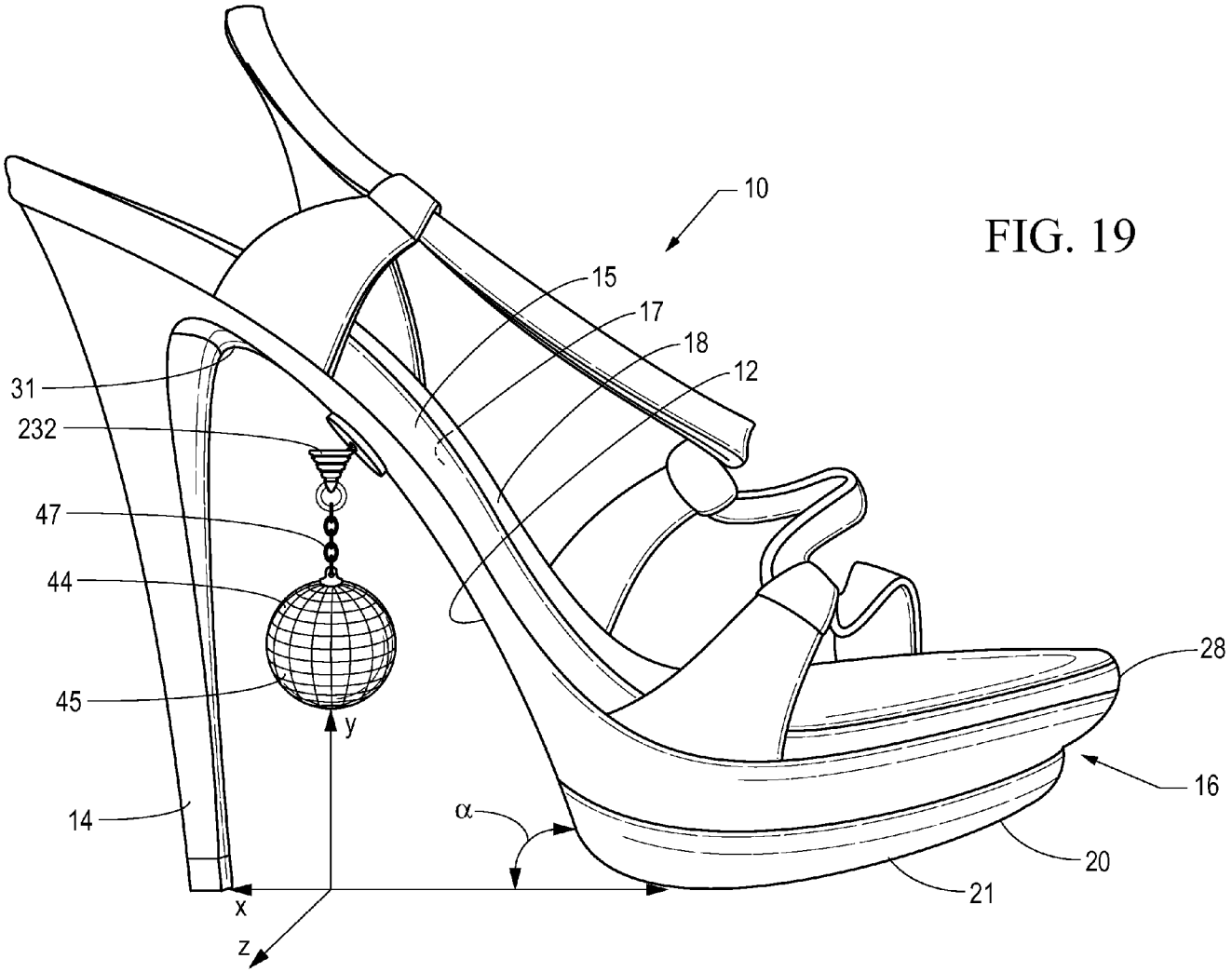
FIG. 19 is a side elevational view of a shoe comprising a charm holder device and a selectively detachable charm.
Figure 20:
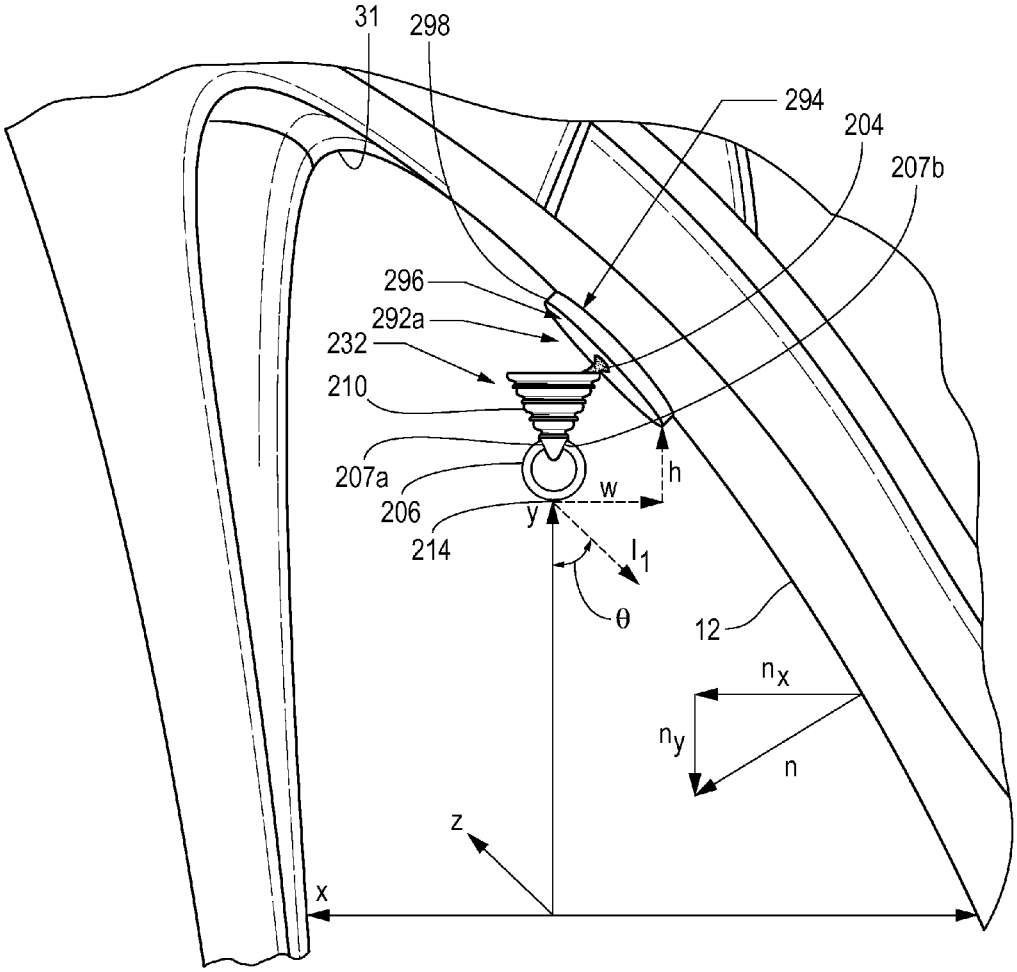
FIG. 20 is a close-up view of the charm holder device of FIG. 19.

Referring to FIG. 19, an alternate example of a shoe 10 comprising a charm holder device 232 is depicted. Like numerals refer to like parts depicted in the previous examples. Shoe 10 comprises heel 14 and toe end 28 which are spaced apart from one another along a first (length) direction of the shoe 10 which defines an x-axis. Shoe 10 also includes a lateral side 15 and a medial side 17. Shoe 10 also comprises an outsole 20 which includes a ground-contacting portion 21, a shank 12, and a heel breast 31. Shank 12 and heel breast 31 are located between ground-contacting portion 21 and heel 14 in a direction along the x-axis. In FIGS. 19 and 20, charm 44 includes a decorative object 45 in the shape of a sphere and a chain 47 that connects the decorative object 45 to the charm device holder 232.

The ground-contacting portion 21 of outsole 20 and the charm holder device 232 are spaced apart in a second direction defining a second axis y. Lateral side 15 and medial side 17 of shoe 10 are spaced apart in a third direction defining a third axis z. Charm 44 is selectively detachable from and attachable to shoe 10 via charm holder device 232. In certain examples, and as shown in FIG. 19, charm 44 is capable of swinging movement relative to the charm holder device 232, heel 14, shank 12, and ground-contacting outsole portion 21. In other examples, charm 44 is capable of swinging along the x-axis, along the z-axis, and/or along directions having components along both the x-axis and the z-axis. As shown in FIG. 19, in certain preferred examples, charm 44 is spaced apart from the ground-contacting portion 21 of outsole 20 in the y-axis direction so that charm 44 does not drag along the ground during use. In the same or other examples, charm 44 is spaced apart from shank 12 in a first direction along the x-axis and is spaced apart from heel 14 in a second direction along the x-axis so that it can swing freely along the x-axis. Similarly, in the example of FIG. 19, charm holder device 232 is itself spaced apart from the ground-contacting portion 21 of outsole 20 in the y-axis direction and is located on the shank 12 of outsole 20.

Referring to FIG. 20, a close-up view of charm holder device 232 is provided. Charm holder device 232 comprises a shoe attachment portion 292*a*, a body 210, and a charm keeper 206. Body 210 may take a variety of polygonal, regular, or irregular three-dimensional shapes, but in preferred examples is a decorative ornament. In the specific example of FIGS. 19 and 20, body 210 is in the shape of a pyramid.

In the illustrated example body 210 is located between charm keeper 206 and shoe attachment portion 292*a* along a direction that projects away from shoe attachment portion 292*a*. The specific direction in FIG. 20 is the y-axis direction (i.e., the direction that is perpendicular to the ground-contacting portion 21 of outsole 20). In certain examples, body 210 may be selectively attachable to and detachable from shoe attachment portion 292*a*. However, in the particular example of FIGS. 19 and 20, body 210 is fixedly attached to shoe attachment portion 292*a*. Body 210 may be integrally formed with shoe attachment portion 292*a* to provide such fixed attachment. Alternatively, shoe attachment portion 292*a* and body 210 may be separately formed and then attached to one another.

In certain examples, charm holder device 232 is selectively attachable to and detachable from outsole 20 of shoe 10. In other examples, charm holder device 232 is fixedly attached to outsole 20 of shoe 10. In one selectively attachable and detachable example, shoe attachment portion 292*a* comprises a magnetic material and a complementary magnetic material is embedded between the inner sole 18 and outer sole 20 along shank 12 so that when shoe attachment portion 292*a* is placed in contact with outer sole 20, it is held to the out sole 20 by magnetic attraction to the complementary magnetic material. In other selectively attachable and detachable examples, shoe attachment portion 292*a* may be configured with a hook or loop fastener that is selectively attachable to a complementary hook or loop fastener affixed to out sole 20.

Shoe attachment portion 292*a* is preferably a thin circular, triangular, or square shaped structure having a shoe contacting surface 294 that abuttingly engages the outsole 20 at a location between the sole ground-contacting portion 21 and the heel 14 in a direction along the x-axis. In general, shoe attachment portion 292*a* may be located at the shank 12 or the heel breast 31, but is shown located at shank 12 in FIGS. 19 and 20. However, as will be discussed further below, in certain examples the shoe attachment portion 292*a* may engage a surface of a shoe other than one along the outsole.

In the example of FIGS. 19 and 20, first shoe-contacting surface 294 of shoe attachment portion 292*a* is substantially planar. Shoe attachment portion 292*a* also includes a second surface 296 opposite the first surface 294. In the example of FIGS. 19 and 20, second surface 296 is also substantially planar. Shoe attachment portion 292*a* also has a thickness that defines a perimeter surface 298. In certain examples, including the example of FIGS. 19 and 20, the shoe-contacting surface 294 has a surface area, the perimeter surface 298 has a surface area, and the surface area of shoe contacting surface 294 is greater than the surface area of perimeter surface 298. In certain examples, the surface area of second surface 296 of shoe attachment portion 292*a* is also greater than the surface area of the perimeter surface 298. In general, increasing the surface area of contact between the outsole 20 along shank 12 and the first surface 294 at a given charm holder device 232 weight better ensures that the charm holder device 232 remains affixed to outsole 20. The first and second surfaces 294 and 296 of shoe attachment portion 292 may have a variety of shapes (when viewing surfaces 294 and 296 along a direction perpendicular to surfaces 294 and 296), including circles, ovals, squares, rectangles, and triangles. In certain preferred examples, the shape is selected from the group consisting of circles, squares, and rectangles. In the embodiment of FIGS. 19 and 20, each of the first and second surfaces 294 and 296 is in the shape of a circle when viewed along a direction perpendicular to first and second surfaces 294 and 296.

Charm keeper 206 is a closed loop in FIGS. 19 and 20. Charms with clasps that can be selectively opened and closed may be attached to charm keeper 206. In other embodiments, charm keeper 206 may be selectively opened and closed to receive a corresponding portion of a charm. Charm keeper 206 includes a distal-most point 214 (FIG. 20) which is the point spaced farthest from body 210 and a proximal-most point which is connected to or spaced closest to body 210. In FIG. 20, charm keeper 206 has two proximal-most points 207*a* and 207*b*, each of which is connected to body 210.

The surface of charm keeper 206 at distal-most point 214 lies in a plane that is tangent to charm keeper 206. The tangent plane is parallel to the x-z plane and has a normal (i.e., an axis that intersects it at a ninety degree angle) that is parallel to the y-axis. Thus an angle θ may be defined between the y-axis and a line $l_1$ lying in a plane (not shown) parallel to the substantially planar surface 294 of shoe attachment portion 292*a*. In the example of FIGS. 19 and 20, θ is an acute angle, which is preferable when shoe attachment portion 292*a* is attached to shank 12 because shank 12 defines an acute angle α (FIG. 19) with respect to the ground and ground-contacting portion 21 of outsole 20. In other examples, and in particular those in which shoe attachment portion 292*a* is attached to heel breast 31, the angle θ may be substantially 90 degrees as would be the case with the charm holder devices of FIGS. 10-12.

In certain examples, and as shown in FIGS. 19 and 20, the distal-most point 214 of charm keeper 206 is spaced apart from the shoe attachment portion 292*a* by a distance h (FIG. 20) in a direction perpendicular (normal) to the tangent plane in which distal-most point 214 of charm keeper 206 lies. In the same or other examples, distal-most point 214 is spaced apart from the shoe attachment portion 292*a* by a distance w in a direction parallel to the tangent plane. In the example of FIGS. 19 and 20, the distal-most point 214 is spaced apart from the shoe attachment portion 292*a* by a distance h in the direction normal to the tangent plane in which distal-most point 214 lies and by a distance w in the direction parallel to the tangent plane. In addition, in the illustrated example, w is greater than h.

Second surface 296 of shoe attachment portion 292*a* may be characterized as having a central portion surrounded by a border portion. In certain examples, and as best seen in FIG. 20, body 210 is connected to second surface 296 at a central portion of second surface 296. In the case of FIGS. 19 and 20, body 210 is preferably connected to shoe attachment portion 292*a* at or substantially at the radial center of second surface 296. Body 210 is connected to shoe attachment portion 292*a* at a connection point 204. In certain examples, a shoe engaging portion such as the shoe engaging portions 92*b* of FIGS. 10-13 may also be provided to connect body 210 to shoe attachment portion 292*a*. The connection at connection point 204 may be made by soldering, welding, adhesive, mechanical fastening, etc.

In certain examples, including the example of FIGS. 19 and 20, body 210 has an axis of symmetry that is substantially perpendicular to the tangent plane in which distal-most point 214 of charm keeper 206 lies. This structure is also depicted in FIGS. 10 and 11. Body 210 preferably a decorative ornament, and in FIGS. 19 and 20 is a pyramid. In certain examples, body 210 is selectively attachable to and detachable from shoe attachment portion 292*a*. However, in other examples (including FIGS. 19 and 20), body 210 is fixedly attached to shoe attachment portion 292*a*.

Figure 21:
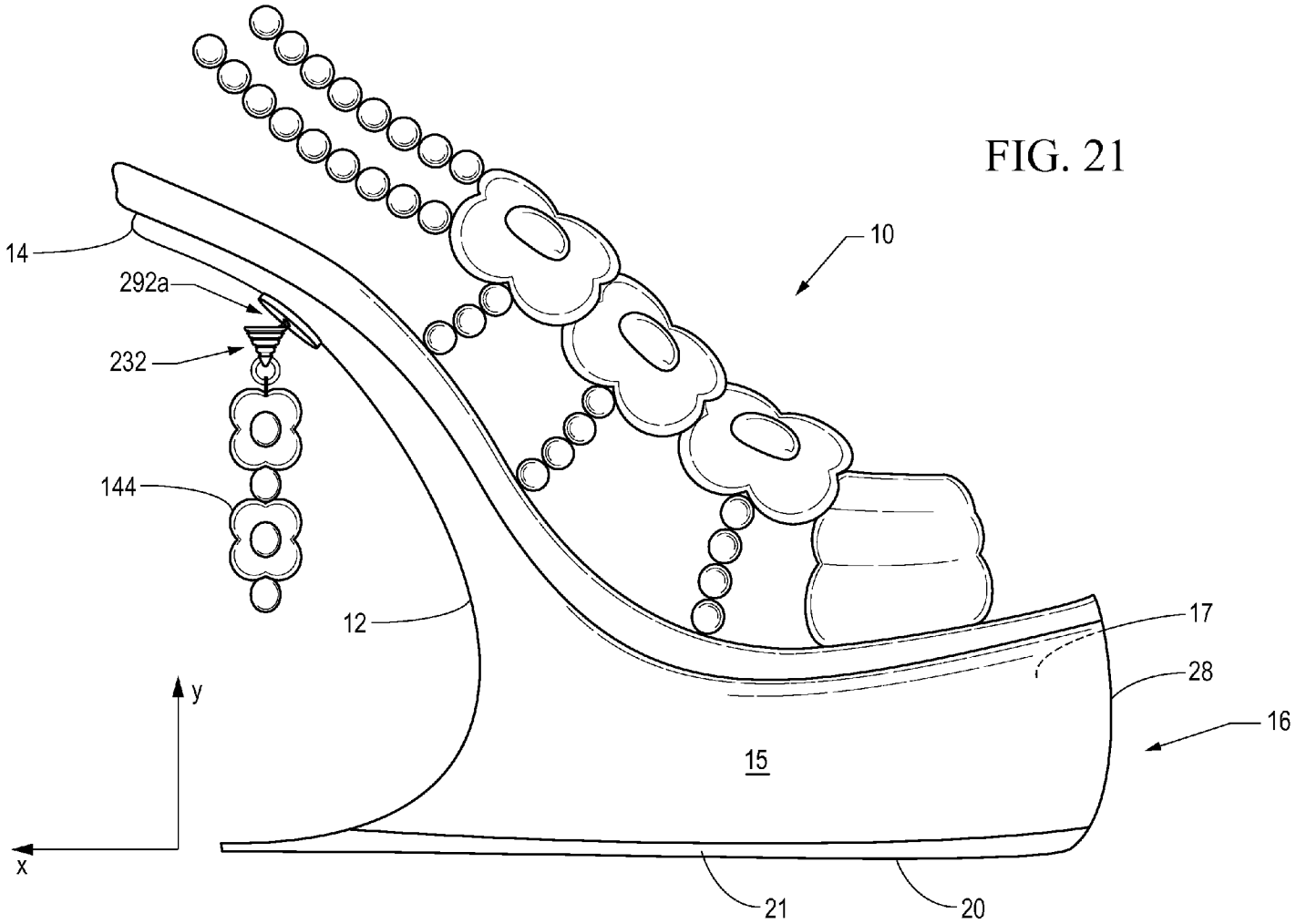
FIG. 21 is a side elevational view of a shoe comprising a charm holder device and a selectively detachable charm in which the heel does not contact the ground.

Referring to FIG. 21, another embodiment of a shoe 10 comprising a charm holder device 232 is depicted. In this embodiment, shoe 10 has a heel 14 that does not contact the ground. Shoe 10 includes a heel shank 12 between heel 14 and ground-contacting portion 21 of outsole 20 in a direction along the x-axis. In some cases, the shoe 10 of FIG. 21 may be referred to as a "heel-less" shoe because there is no ground contacting portion of the shoe beneath (in the y-axis direction) the location where the heel of the foot is positioned. However, for purposes of FIG. 21 the portion of shoe 10 spaced furthest from the toe section 28 in a direction along the x-axis may be referred to as a heel 14. Charm holder device 232 is substantially identical to the charm holder device of FIGS. 19-20. However, charm 145 on the shoe 10 of FIG. 21 is different than the charm 45 of FIG. 19.

Figure 22:
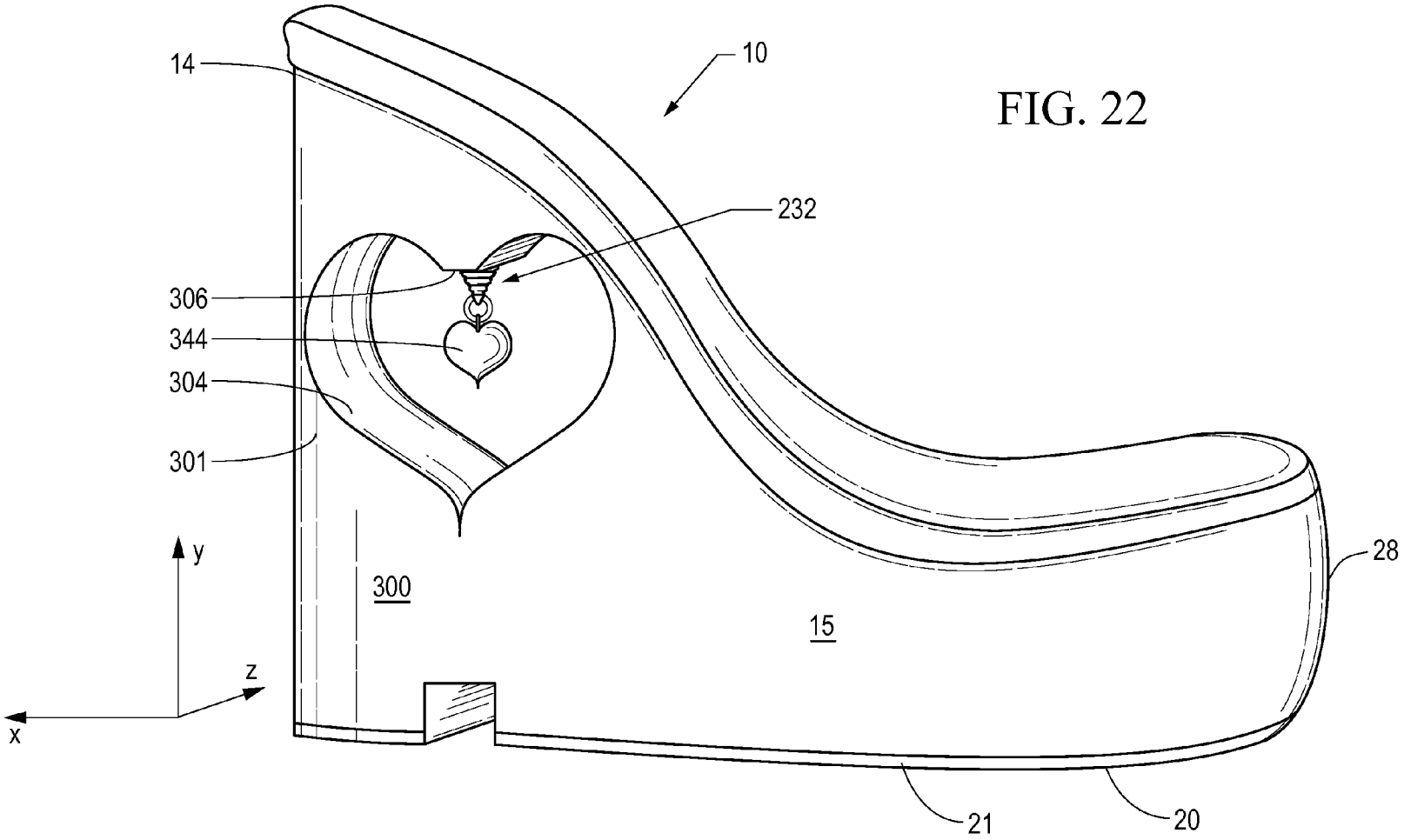
FIG. 22 is a side elevational view of a wedge shoe (with the vamp omitted) comprising a charm holder attached to within a cut-out portion of the shoe.

Referring to FIG. 22, a further embodiment of a shoe 10 comprising a charm device holder 232 connected to charm 344 is depicted. The shoe 10 of FIG. 22 is a wedge shoe (shown with the vamp omitted) and does not include a heel shank that provides sufficient clearance to the ground to allow for the attachment of charm holder device 232. Charm holder device 232 is configured similarly to charm holder device 232 of FIGS. 19-20. In this example, a cut-out region 301 is formed which extends from the surface 300 of lateral side 15 to the opposing surface 302 (not shown) of medial side 17 (not shown) of shoe 10. Cut-out region 301 includes an inner surface 304 in the interior of the cut-out region 301. Inner surface 304 includes a downward-facing portion 306 that faces in the direction of ground-contacting portion 21 of outsole 20 (i.e., downward-facing portion 306 is substantially parallel to the x-z plane). The shoe attachment portion 292*a* (not separately shown in FIG. 22) of charm holder device 232 is attached to the downward-facing portion 306 of cut-out region 301. In this example, the surfaces 294 and 296 (not shown) of the shoe attachment portion 292*a* are generally parallel to the ground-contacting portion 21 of outsole 20 and to the x-z plane. However, the cut-out region 301 could include sloped sidewalls, in which case the shoe attachment portion 292*a* could be oriented at an angle with respect to ground-contacting portion 21 of outsole 20 as is the case in FIGS. 19 and 20. Thus, in the example of FIG. 22, charm 344 is swingable along both the x and z axis directions relative to outsole 20 and relative to charm holder device 232.

The charm holder devices 32, 232 described herein may be made of plastic, metal, or any other substantially rigid material. However, in preferred examples, the charm holder devices 32, 232 include an outer surface with a metallic appearance. In certain examples, the outer surface comprises a non-tarnishing material. In the same or other examples, the outer surface has a shiny appearance. In one example, charm holder devices 32, 232 are formed from a brass base material covered with a rhodium plating. In another example, the charm holder devices 32, 232 are formed from a brass base material covered with a gold plating. In one example where a rhodium plating is used, the plating is silver and white in color.

As mentioned previously, charm holder devices 32, 232 may be affixed to shoe 10 or selectively attachable to and detachable from it. In those examples where the charm holder devices are fixedly attached, the fixed attachment may be provided by mechanical or adhesive means. In fixed attachment examples wherein the shoe attachment portion 292*a* is attached to a rubber, plastic, or fabric material on shoe 10, adhesive attachment is preferable. In one example, a neoprene adhesive containing polychloropene rubber is used. One such suitable adhesive is a Dual #88 Super Strength All Purpose Cement supplied by R-H Products, Co., Inc. of Acton, Mass. Other suitable adhesives include cyanoacrylate adhesives, one example of which is an ethyl cyanoacrylate adhesive sold under the name Gorilla Super Glue by the Gorilla Glue Company of Cincinnati, Ohio.

The charm holder devices 32 and 232 may be applied to different shoes and at different shoe locations than those described previously. In general, the surface of the shoe to which the charm holder device 32, 232 is attached will preferably have a surface normal (i.e., axis perpendicular to the surface) that is not parallel to the ground-contacting portion 21 of outsole 20. The surface normal preferably comprises a component that is perpendicular to the ground contacting portion 21 of the shoe. In other words, the surface normal is the vector sum of two component vectors, one of which is perpendicular to ground-contacting portion 21. For example, in FIGS. 19 and 20, shoe attachment portion 292*a* of charm holder device 232 is attached to the heel shank 12. The heel shank 12 has a surface normal vector n that can be resolved into two component vectors, one of which is parallel to the y-axis ($n_y$), and the other of which is parallel to the x-axis ($n_x$). The vector parallel to the y-axis ($n_y$) is perpendicular to ground-contacting portion 21 of outsole 20. This orientation allows the charm attached to the charm holder device 32, 232 to hang freely and swing, at least to some extent.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A shoe comprising: a charm holder device including:

a shoe attachment portion, comprising a substantially planar surface;

a charm engaging portion, including a body connected to the shoe attachment portion and projecting in a direction away from the shoe attachment portion; and a charm keeper connected to the body such that the body is disposed between the shoe attachment portion and the charm keeper along a direction away from the substantially planar surface; and a sole having a ground-contacting surface, wherein the substantially planar surface of the charm holder device shoe attachment portion is attached to a charm-attachment surface of the shoe, the shoe has a heel, the heel is spaced apart from the ground-contacting surface of the sole in a first direction defining a first axis, the charm engaging portion is located between the heel and the ground-contacting surface of the sole along the first axis and is spaced apart from the ground-contacting surface of the sole in the first direction along the first axis and from the heel in a second direction along the first axis, and wherein the charm engaging portion is spaced apart from the ground-contacting surface of the sole in a direction perpendicular to the ground-contacting surface of the sole.

2. The shoe of claim 1, further comprising a shoe engaging portion, wherein the shoe engaging portion is connected to the shoe attachment portion and to the body.

3. The shoe of claim 1, wherein the substantially planar surface is a substantially planar first surface having a shape selected from a circle, a triangle, and a square.

4. The shoe of claim 1, wherein the substantially planar surface has a surface area, the shoe attachment portion has a perimeter and a thickness perpendicular to the substantially planar surface, and the perimeter and thickness define a second surface area that is less than the surface area of the substantially planar surface.

5. The shoe of claim 1, wherein the substantially planar surface is disc-shaped.

6. The shoe of claim 1, wherein the shoe attachment portion has a central region and a boundary region, and the body is connected to the central region.

7. The shoe of claim 1, wherein the body is selectively detachable from the shoe attachment portion.

8. The shoe of claim 1, wherein the body is fixedly attached to the shoe attachment portion.

9. The shoe of claim 1, wherein the body is a decorative ornament.

10. The shoe of claim 1, wherein the charm keeper includes a proximal point and a distal point, the proximal point is located between the distal point and the body, the distal point lies in a plane tangent to the distal point, and the distal point is spaced apart from the shoe attachment portion in a direction perpendicular to the plane tangent to the distal point.

11. The shoe of claim 10, wherein the direction perpendicular to the plane tangent to the distal point defines a first axis, the substantially planar surface defines a second axis parallel to the substantially planar surface, and the first axis defines an acute angle with respect to the second axis.

12. The shoe of claim 1 further comprising a charm, wherein the charm is attached to the charm keeper and is capable of swinging relative to the charm holder device.

13. The shoe of claim 1, wherein the charm-attachment surface of the shoe is on the sole.

14. The shoe of claim 1, wherein the substantially planar surface is fixedly attached to the charm-attachment surface of the shoe.

15. The shoe of claim 14, wherein the substantially planar surface is adhesively attached to the charm-attachment surface of the shoe.

16. The shoe of claim 1, wherein the substantially planar surface is removably attached to the charm-attachment surface of the shoe.

17. The shoe of claim 1, wherein the substantially planar surface is spaced apart from the ground-contacting surface in a direction substantially perpendicular to the ground-contacting surface.

18. The shoe of claim 1, wherein the substantially planar surface is located between the heel and the ground-contacting surface of the sole.

19. The shoe of claim 1, further comprising a charm attached to the charm keeper.

20. The shoe of claim 19, wherein the charm is capable of swinging movement relative to the shoe.

21. The shoe of claim 20, wherein the shoe has a heel and a toe end defining a first axis, a lateral side and a medial side defining a second axis, and the charm is capable of swinging along the first and second axes.

22. A shoe, comprising:

a sole having a ground-contacting surface;

a heel spaced apart from the ground-contacting surface along an axis;

a charm suspended from a charm-attachment surface of the shoe, wherein an axis perpendicular to the charm-attachment surface is not parallel to the ground-contacting surface of the shoe, and the charm is spaced apart from the ground-contacting surface of the sole in a direction perpendicular to the ground-contacting surface of the sole; a charm holder device attached to the charm-attachment surface of the shoe, wherein the charm is attached to the charm holder device, the charm holder device comprises a shoe attachment portion having a substantially planar surface attached to the charm-attachment surface of the shoe and a charm engaging portion, the charm engaging portion including a body connected to the shoe attachment portion and projecting in a direction away from the shoe attachment portion, the charm engaging portion further including a charm keeper connected to the body such that the body is disposed between the shoe attachment portion and the charm keeper, and the charm engaging portion is located between the heel and the ground-contacting surface of the shoe along the axis.

23. The shoe of claim 22, wherein the charm-attachment surface is on the sole of the shoe.

24. The shoe of claim 22, wherein the charm is located between the heel and the ground-contacting surface in a direction parallel to the ground-contacting surface.

25. The shoe of claim 22, wherein the charm holder is fixedly attached to the charm-attachment surface of said shoe.

26. The shoe of claim 22, wherein the charm holder is selectively detachable from the charm-attachment surface of said shoe.

* * * * *